US008206494B2

(12) United States Patent
Galbrun et al.

(10) Patent No.: US 8,206,494 B2
(45) Date of Patent: Jun. 26, 2012

(54) DEVICE FOR AIR/WATER EXTRACTION BY SEMI-HUMID ELECTROSTATIC COLLECTION AND METHOD USING SAME

(75) Inventors: Ernest Galbrun, Saint Martin d'Hères (FR); Jean Luc Achard, Grenoble (FR); Yves Fouillet, Voreppe (FR); Raymond Charles, Saint Jean de Moirans (FR)

(73) Assignees: CNRS, Paris (FR); Commissariat a l'Energie Atomique, Paris (FR)

( * ) Notice: Subject to any disclaimer, the term of this patent is extended or adjusted under 35 U.S.C. 154(b) by 869 days.

(21) Appl. No.: 11/996,879

(22) PCT Filed: Jul. 24, 2006

(86) PCT No.: PCT/EP2006/007282

§ 371 (c)(1),
(2), (4) Date: Aug. 8, 2008

(87) PCT Pub. No.: WO2007/012447

PCT Pub. Date: Feb. 1, 2007

(65) Prior Publication Data

US 2008/0295687 A1 Dec. 4, 2008

(30) Foreign Application Priority Data

Jul. 28, 2005 (FR) ..... 05 08100

(51) Int. Cl.
*B03C 3/014* (2006.01)

(52) U.S. Cl. ..... 96/52; 95/58; 95/60; 96/61; 96/96; 96/97; 96/98

(58) Field of Classification Search ..... 96/49, 52, 96/61, 96–98; 95/58, 60; 239/3, 706, 707
See application file for complete search history.

(56) References Cited

U.S. PATENT DOCUMENTS

| | | | | | |
|---|---|---|---|---|---|
| 3,765,154 | A | * | 10/1973 | Hardt et al. | 96/88 |
| 3,768,258 | A | * | 10/1973 | Smith et al. | 60/275 |
| 4,010,011 | A | * | 3/1977 | Reif | 96/61 |
| 4,435,190 | A | * | 3/1984 | Taillet et al. | 95/61 |
| 4,544,382 | A | | 10/1985 | Taillet et al. | |
| 4,597,780 | A | | 7/1986 | Reif | |
| 5,648,049 | A | * | 7/1997 | Jones et al. | 422/170 |
| RE35,990 | E | * | 12/1998 | Greene et al. | 110/345 |
| 5,914,454 | A | * | 6/1999 | Imbaro et al. | 95/64 |
| 6,365,112 | B1 | | 4/2002 | Babko-Malyi et al. | |

(Continued)

FOREIGN PATENT DOCUMENTS

FR 2 101 249 A 3/1972

(Continued)

*Primary Examiner* — Richard L Chiesa
(74) *Attorney, Agent, or Firm* — Millen, White, Zelano, Branigan, P.C.

(57) ABSTRACT

The invention concerns a device for air/water extraction by semi-humid electrostatic collection, comprising a chamber (7) containing a discharge electrode (1) for generating an ion flow from an ionized gas accumulation surrounding the discharge electrode (1) and a counter-electrode (2), an inlet (3) for mixing air and aerosol to be extracted which contains liquid or solid particles, a steam supply tube (8) and an outlet (4) for the cleansed air. The invention is characterized in that the device enables steam to be introduce the steam supply tube (8) in the gap between the discharge electrode (1) and the counter-electrode (2) so as to form a steam sheath (10) enclosing the discharge electrode over its entire length, such that the treated air is not steam-saturated.

17 Claims, 6 Drawing Sheets

U.S. PATENT DOCUMENTS

| | | | | |
|---|---|---|---|---|
| 6,848,374 | B2 * | 2/2005 | Srinivasachar et al. | 110/345 |
| 6,962,620 | B2 * | 11/2005 | Chang et al. | 96/60 |
| 7,758,675 | B2 * | 7/2010 | Naito et al. | 96/61 |
| 2004/0050756 | A1 * | 3/2004 | Flagan | 209/156 |
| 2004/0083790 | A1 | 5/2004 | Carlson et al. | |
| 2004/0226449 | A1 | 11/2004 | Heckel et al. | |
| 2009/0056538 | A1 * | 3/2009 | Srinivasachar et al. | 95/58 |

FOREIGN PATENT DOCUMENTS

| | | | |
|---|---|---|---|
| GB | 2403672 | A * | 1/2005 |
| WO | WO 2004/041440 | A1 * | 5/2004 |

* cited by examiner

DEVICE FOR AIR/WATER EXTRACTION BY SEMI-HUMID ELECTROSTATIC COLLECTION AND METHOD USING SAME

This application is the US national phase application of International Application No. PCT/EP2006/007282, filed Jul. 24, 2006.

The invention relates to a device for air/water extraction by wet electrostatic collection, in particular semi-wet electrostatic collection, comprising a chamber comprising a discharge electrode for creating a stream of ions from an ionized pocket of gas surrounding the discharge electrode and a counterelectrode, an inlet for the air and aerosol mixture to be treated which comprises liquid or solid particles, a vapor delivery tube and an outlet for the treated air, and to a process using this device. These devices will be mentioned below under the term of "electrostatic filter".

It is of great importance to be able to separate, in the atmosphere, the particulate constituents of gases, in order either to clean the treated air (for example in the vicinity of industrial buildings) or to analyze the particles which it transports. One very important separation method consists of the electrostatic separation of impurities in an electrostatic filter. However, in the case of the cleaning of air, large-size structures are necessary in order to obtain collecting electrodes having the greatest possible surface area, in order to be able to increase the efficiency of the cleaning. Large structures are then necessary and electrostatic filters of this size demand, for this purpose, large amounts of electrical energy intended for the creation and maintenance of the electrostatic fields. Such electrostatic filters thus can only be used on stationary supports. In the present case, where it is desired to use electrostatic filters to analyze the particles present in air, mobile instruments are more advantageous since the monitoring areas of interest are not necessarily fixed nor in the proximity of a source of electricity. In this case, it remains essential to have a very good level of collection in order to be able to detect particles even in very small amounts.

There currently exist two types of device, dry electrostatic filters (known simply as electrostatic filters) and wet electrostatic filters:

An electrostatic filter (ESP, electrostatic precipitator) is a device which cleans the gas by using the electrostatic forces produced by an electric field through which the particles pass. This electric field, which is high (several tens of kV per cm) and nonuniform, is induced by two electrodes. It has more specifically two effects: it creates a stream of ions from an ionized pocket of gas surrounding one of the electrodes, typically in the tip or wire form, brought to a high potential: this phenomenon is known as the corona effect. The particles which are made to pass through this stream of ions are then coated with these ions and charged. They become sensitive to Coulomb forces, which carry them over the cylindrical or planar counterelectrode brought to ground. The electrostatic filter is highly effective for all the sizes with a minimum generally below a micron. Devices operating according to this principle may be found commercially (for example at United Air Specialists Inc.). The advantages are compactness and an efficiency of approximately 1 for the particles greater than a micron. The main disadvantage of these systems lies in the collection of the submicronic particles, the efficiency of which is mediocre.

The second family of electrostatic filters is composed of the wet electrostatic filters. In this case, the air to be treated comprising the particles is mixed beforehand with water vapor introduced in the form of droplets into a unit upstream of the collecting unit. The objective here is to increase the size of the droplets by condensation and to render the smaller particles more sensitive to electric fields. Such systems are also available commercially (for example from Wheelabrator Air Pollution Control Inc.). These systems, although making possible the collection of very small particles with an excellent yield, are intended for industrial use and require very large amounts of water (several tens of liters per hour). They are therefore unsuitable for portable applications.

WO-2004/041440 presents a portable electrostatic filter comprising:

an air inlet system formed of an air passage equipped with an inlet and an outlet at its ends and with an air pump intended to suck the air via said inlet through said air passage and then out of said outlet, thus creating an air stream through said air passage;

an ionization section situated in said air inlet system close to said inlet which is capable of ionizing the analytes in the air stream; and a collecting electrode situated in said air inlet system between the ionization section and the outlet of said air inlet system, where said collecting electrode comprises a vertical tubular electrode and is exposed to said air stream.

The electrostatic filter of WO-2004/041440 additionally comprises a tank comprising a liquid which is connected hydraulically to the collecting electrode; a liquid pump for pumping said liquid from said tank inside the collecting electrode, so that said liquid flows over the outside of said collecting electrode and is returned to the tank. The liquid serves to continually or periodically clean the collecting electrode, which prevents shutdown of the electrostatic filter in order to clean or replace the electrodes. The liquid is typically transported to a waste control system, where it will be filtered or at the very least cleaned.

The electrostatic filter of WO-2004/041440 is thus not a wet electrostatic filter; the water is involved only during the recovery of the waste at the counterelectrode and not during the collecting. The drawback of this device is thus that of all dry precipitators: it is not very efficient with regard to small particles.

U.S. Pat. No. Re. 35990 (reissue) presents a method and a device for treating waste. This waste is incinerated in an oxygen-rich atmosphere to produce ash and waste gases and these gases are incinerated in an oxygen-depleted atmosphere to produce incinerated waste gases. An electrostatic filtration module is used to purify the incinerated gas which enters it, thus rendering it more acceptable from the environmental viewpoint.

GB 2 403 672 presents an electrostatic filter in which the droplets produced by an ultrasonic droplet generator can be used to prevent the formation of solid particles in the porous collecting electrode. Consequently, water drops can normally be added to the aerosol before being introduced into the electrostatic filter.

These last two solutions involve a consumption of water and of energy which are incompatible with portable use.

FR 2101249 A discloses an electrostatic precipitator of droplets which is intended for the removal of dust and other pollutants in the gas stream. The electrostatic force in the electrostatic field sucks the fluid out of the nozzle and causes the fluid to break up into small droplets. The droplets, which have a very high charge to weight ratio, undergo very high acceleration due to the field prevailing between the nozzles and the collecting plate. The droplets which are moving may encounter the particles present in the gas stream and collide with them in the gas stream, removing them towards the collecting plate. The residence time of the droplet in the gas stream is very short but, by virtue of the high speed, the probability of collision with particles is very high. A small amount of vapor present in the reduced gas is thus sufficient to obtain an improved collecting efficiency with respect to a dry electrostatic precipitator. In order to avoid an increase in vapor entering the discharge electrode over all its length, the water droplets according to FR 201249 A are accelerated when exiting from the nozzles forming the discharge electrodes and are subsequently distributed throughout all the gas streams. The vapor is reduced by a vapor delivery tube in the space between the discharge electrode and the counterelectrode. One characteristic of FR 201249 A is that the discharge electrode is formed by the nozzles themselves, which act at the same time as vapor delivery tube.

U.S. Pat. No. 4,544,382 A discloses an electrostatic filter which can in particular be used at high temperatures. The particles present in a gas stream to be cleaned are charged to a specific region of the filter. The principle of the device according to U.S. Pat. No. 4,544,382 A is that the compressed and wet air quickly enters the device and, in the wet gas, a corona discharge takes place between a needle and the nozzle. In the narrowed part of the injector, the compressed and wet air undergoes an expansion which creates ice microparticles which exit from the injector and trap the particles charged in the discharge corona.

The objective of the present invention is thus to provide a system which makes possible the collecting of particles in suspension in a gas by a system of electrostatic filters with high efficiency, in particular the collecting of liquid or solid particles having a size of between 10 nm and 100 μm, and a consumption of energy and of products (for example water) compatible with portable use.

Moreover, this invention is targeted at making possible the efficient collection of submicronic particles in suspension in air for the purpose of the analysis thereof. In addition, this device makes possible portable applications and has a consumption of energy and of products (essentially of water) sufficiently low to be suitable for autonomous use.

The present invention thus relates to a device for air/water extraction by wet electrostatic collection, comprising a chamber comprising a discharge electrode for creating a stream of ions from an ionized pocket of gas surrounding the discharge electrode and a counterelectrode, an inlet for the air and aerosol mixture to be extracted which comprises liquid or solid particles, a vapor delivery tube and an outlet for the cleaned air, characterized in that the device makes it possible to introduce the vapor via said vapor delivery tube into the space between the discharge electrode and the counterelectrode so as to form a sheathing of vapor surrounding the discharge electrode over its entire length, so that the air treated is not saturated in vapor.

The present invention also relates to a process for collecting, by the wet electrostatic method, liquid or solid particles with a size of between 10 nm and 100 μm in suspension in a gas using the device described above, characterized in that:

(a) the vapor is introduced into the space between the counterelectrode and the discharge electrode in order to establish a sheathing of vapor around the discharge electrode,
(b) an air and aerosol mixture is introduced in the form of a flow into the space between the discharge electrode and the counterelectrode,
(c) the vapor molecules are ionized by the discharge electrode,
(d) the ionized vapor molecules charge particles,
(e) the charged particles grow to form droplets, and
(f) said droplets are conveyed to the counterelectrode and are precipitated on the latter,
(g) the droplets are recovered and transported in order to be analyzed.

Other characteristics and advantages of the invention will emerge from the description which will follow, with reference to the figures of the appended drawings. The exemplary embodiments described with reference to the drawings appended herewith are in no way limiting.

FIG. 5 illustrates the use of air inlets tangential to the walls of the main channel ("main pipe") in order to create a helical air flow.

Figure 9:
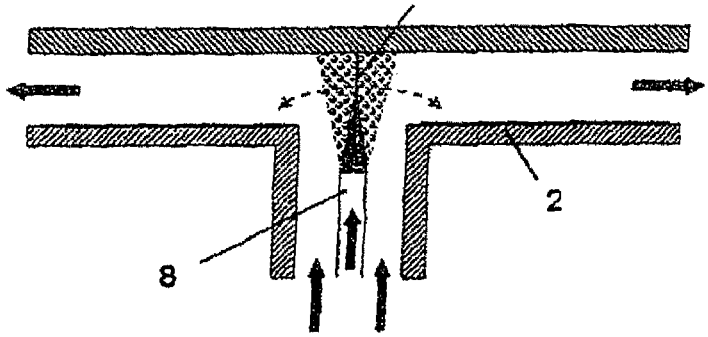

FIG. 9 describes an exemplary embodiment of the present invention with the use of a flat counterelectrode which can be envisaged for facilitating the collecting of the particles.

Figure 10:
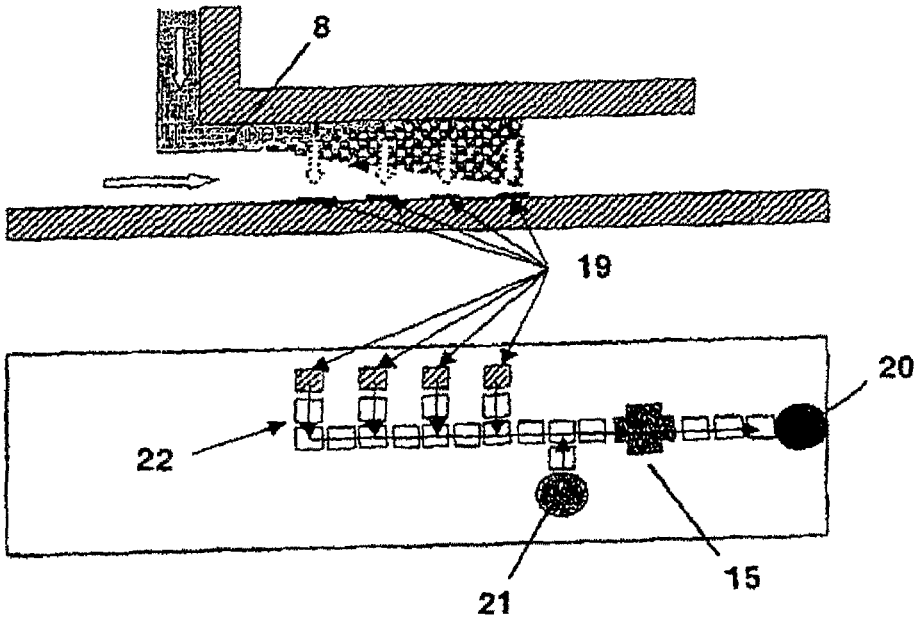

FIG. 10 shows another exemplary embodiment according to the present invention (second example of flat configuration which can be envisaged) for guiding the vapor/aerosol mixture.

In the figures, identical reference numbers are used to denote identical parts.

Figure 1:
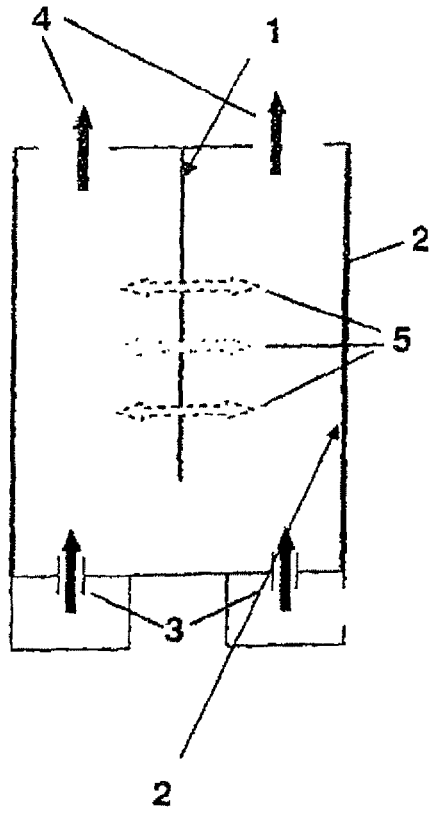
FIG. 1 Prior Art
FIG. 1 illustrates the principle of the dry electrostatic filter according to the state of the art.

FIG. 1 illustrates the principle of the dry electrostatic filter according to the state of the art. In FIG. 1, 1 refers to the discharge electrode, 2 to the counterelectrode, 3 to the inlet for the air and aerosol mixture, 4 to the outlet for the cleaned air and 5 to the direction of the ionic wind, in other words of the charged particles from the discharge electrode 1 to the counterelectrode 2. By virtue of the physical effects involved, the particles which are subjected to the ionic wind created at the electrode 1 (corona discharge) are charged. Subsequently, the charged particles are transported to the counterelectrode 2 (electrostatic collector). It is possible to charge the particles upstream, at the level of the inlets, in which case the collecting alone—which requires a much lower voltage—takes place by virtue of the device opposite. This process makes it possible to optimize the two independent physical phenomena while losing in compactness. In addition, the use of such a process requires that the path of the treated air between the charging unit and the collecting unit be very short, in order not to allow the particles time to become discharged.

Figure 2:
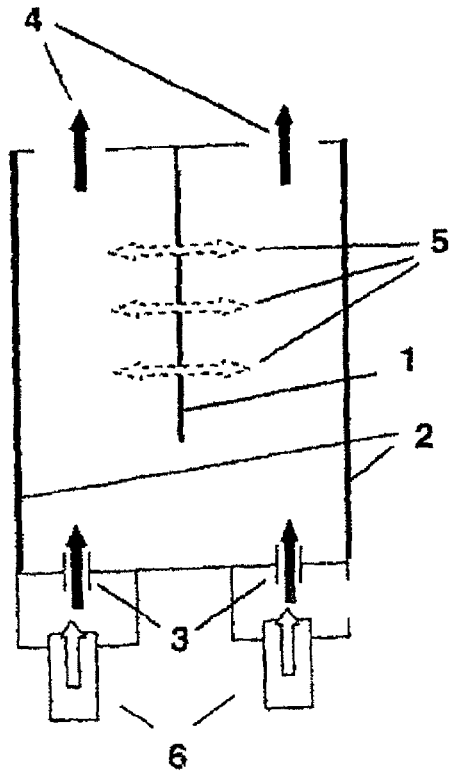
FIG. 2 Prior Art
FIG. 2 illustrates the principle of the wet electrostatic filter according to the state of the art.

FIG. 2 illustrates the principle of the wet electrostatic filter according to the state of the art. In FIG. 2, 6 refers to a container for a liquid, generally water, which will be used for the formation of the droplets. By virtue of the physical mechanisms involved, drops are nucleated around the particles which it is desired to collect. A mist is formed. Particles encapsulated in the droplets are collected by electrostatic force.

This electrostatic filter makes it possible to very efficiently collect the small particles which are artificially enlarged. However, it has the disadvantage that the amount of solvent (generally water) necessary for the nucleation around the submicronic particles is very large. Thus, in order to treat 500 l/min with the capture of 1 μm particles, 200 l of water are consumed daily.

Figure 3:
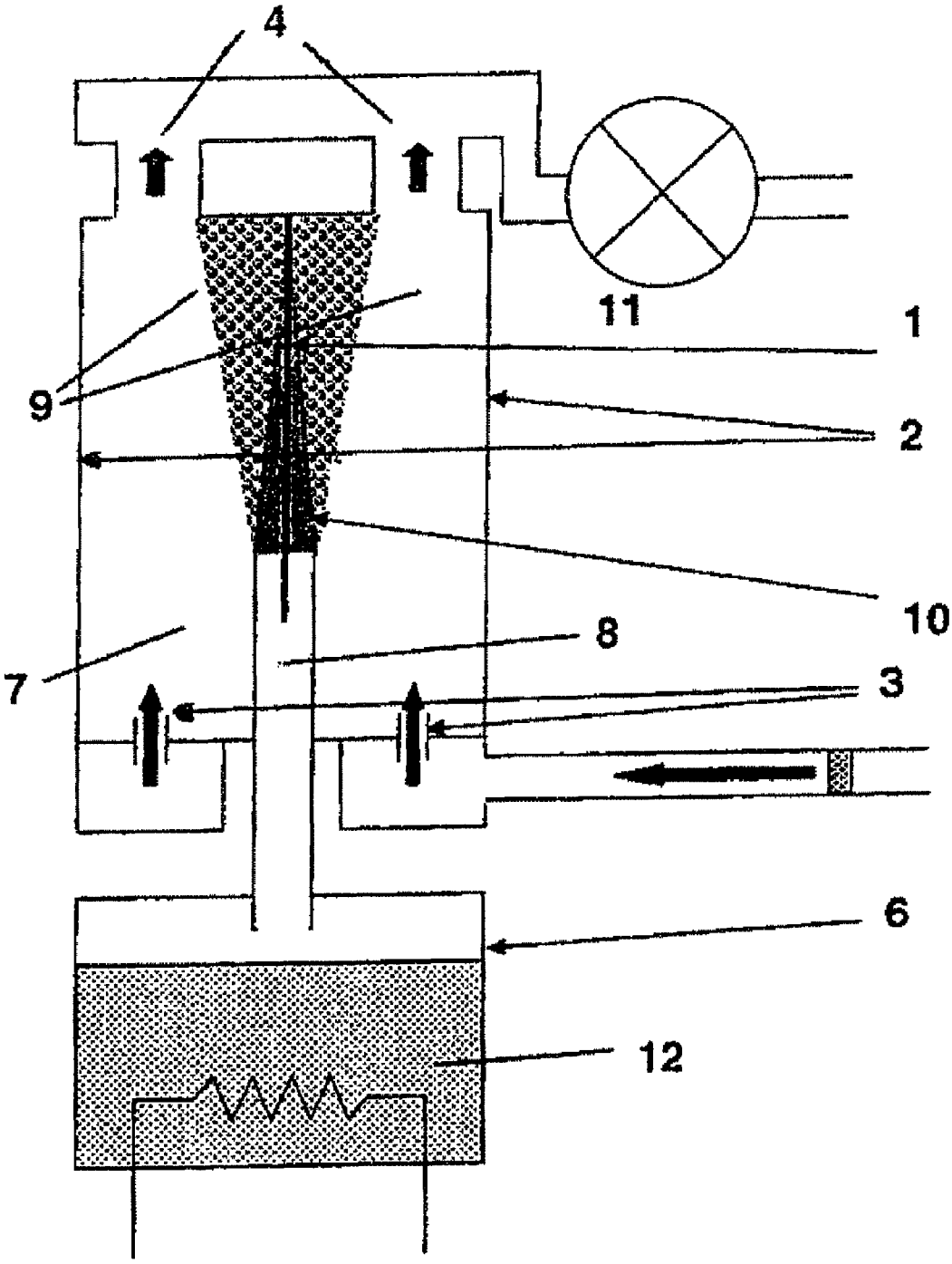
FIG. 3 illustrates the operating principle of the semi-wet electrostatic collector of a device according to the present invention.

FIG. 3 illustrates the operating principle of the device for air/water extraction by semi-wet electrostatic collection of the present invention. The device for air/water extraction by wet electrostatic collection of the present invention comprises a chamber 7 comprising a discharge electrode 1 for creating a stream of ions from an ionized pocket of gas surrounding the discharge electrode 1 and a counterelectrode 2, an inlet 3 for the air and aerosol mixture to be cleaned which comprises liquid or solid particles, a vapor delivery tube 8 and an outlet 4 for the cleaned air, characterized in that the device makes it possible to introduce the vapor via said vapor delivery tube 8 into the space 9 between the discharge electrode 1 and the counterelectrode 2 so as to form a sheathing of vapor 10 surrounding the discharge electrode 1 over its entire length, with the result that the treated air is not saturated with vapor. In FIG. 3, the numbers 6 and 12 refer to the (water) vapor generator. 6 indicates the solvent tank and 12 the heating in order to produce the vapor from the solvent. 11 indicates a pump which drives the air and aerosol mixture through the device.

The solvent (preferably water) vapor is produced from a store situated upstream 6. It is carried into the chamber 7. The discharge electrode 1 is preferably situated in the axis of the vapor delivery tube 8 and brought to high voltage by a mobile power supply (which is not shown here). The voltage is generally from 5 to 10 kV. The discharge electrode 1 can either be a tip or a wire. It can be held and guided from the vapor delivery tube or from the pipe.

The main stream of air comprising the particles (the air and aerosol mixture) enters at 3 at the periphery of the counter electrode 2. Thus, a sheathing of vapor 10 surrounds the discharge electrode 1 over its entire length. In this way, discharging takes place in the vapor and the ions created are, in the case of water, $H_3O^+$ ions. If another solvent is used, other ions can be formed. These ions will charge the particles present in the flow, as in a conventional electrostatic filter. The flow rate is such that the flow of air and of aerosol in the pipe preferably remains laminar. The speed of the gas stream will be determined by an action of the pump 11.

At the limit of the sheathing of (water) vapor 10, droplets are formed and encapsulate the particles, as in a wet electrostatic filter. Then, when these droplets are conveyed to the counterelectrode, they carry with them all the particles which they encounter.

In the present invention, the vapor droplets are formed very late. First of all, the vapor is introduced via the nozzle at the end of the vapor delivery tube 8 into the space between the electrodes and the operation is carried out in an unsaturated atmosphere. It is only at the end of the vapor sheathing that the droplets are formed.

This is preferably carried out in the device according to the present invention by virtue of the following properties of the nozzle:

- the end of the discharge electrode lies at a distance from the nozzle which is less than the diameter of the nozzle,
- the water vapor flow rate at the outlet of the nozzle has a value between a few thousandths and five hundredths of the air flow rate.

In addition, the outlet of the nozzle has to lie between the discharge electrode 1 and the counterelectrode 2 in order for the droplets gathered to cross the whole of the space comprising the air and aerosol mixture.

It is particularly advantageous for the vapor exiting from the nozzle to exhibit the following properties: pressure slightly greater than or equal to atmospheric pressure, temperature equal to the boiling point (100° C. at atmospheric pressure) or greater, flow rate lower than five hundredths of the air flow rate. Thus, the air with which the vapor is mixed will not be saturated.

The advantage of the present invention (device and process) is that of enjoying the increase in collecting efficiency similar to that of the wet electrostatic filters while using a much smaller amount of solvent (preferably water), since it is not a matter here of saturating with water vapor all the air treated.

Various solvents can be used in the present invention, provided that they can be vaporized in the device and that the particles present in the vapor can be at least partially ionized. Examples of appropriate solvents: ethanol, acetone, water. These can be used alone or, if possible, as a mixture. As water is preferably used, the vapor is thus water vapor in the device and in the process according to the present invention.

The solvent (preferably water) which has impacted the counterelectrode 2 only has to be recovered in order to be analyzed. In the case of a biological or chemical analysis, it is important for the volume of the solvent thus recovered to be as small as possible in order to avoid excessively great dilution and to promote detection.

Figure 4:
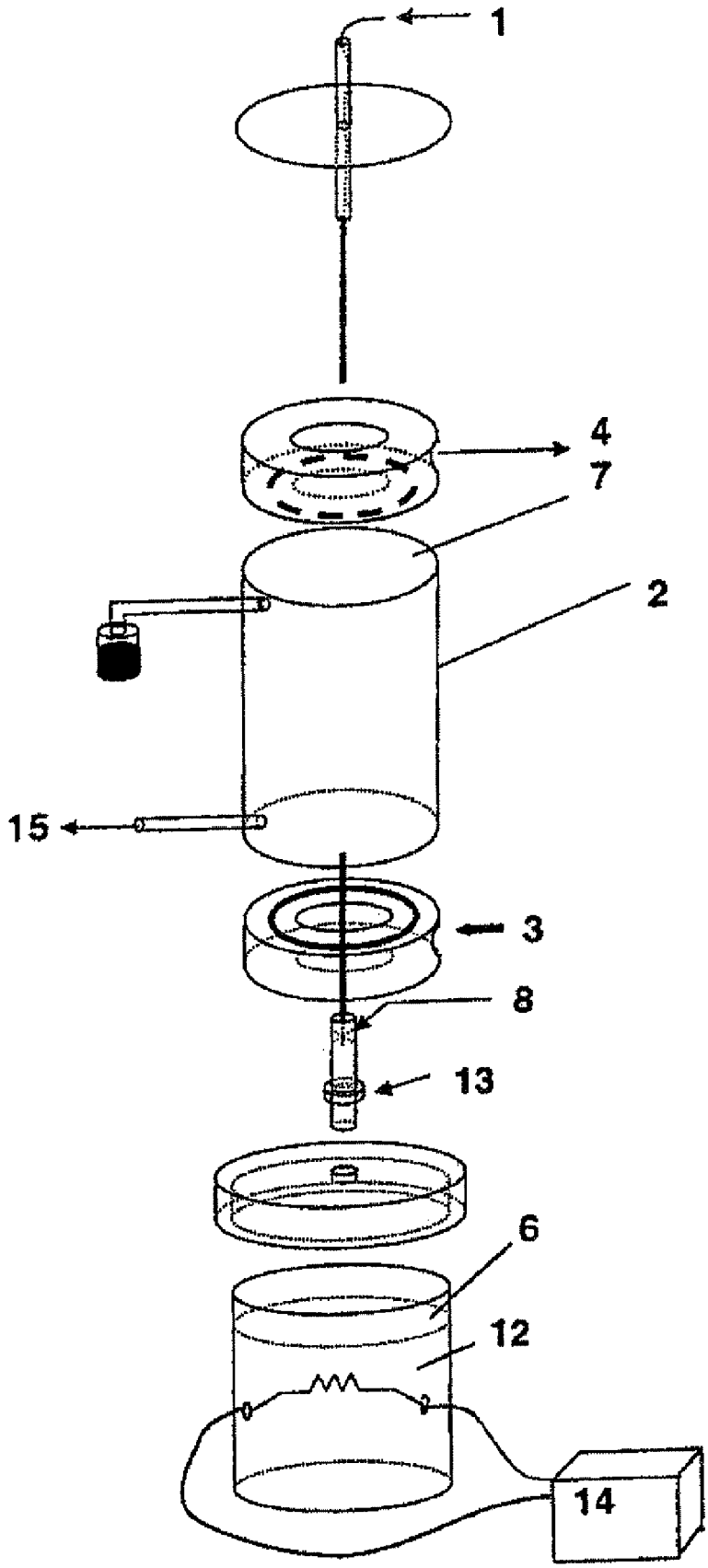
FIG. 4 shows an exploded view of a possible implementation of the device according to the present invention.

FIG. 4 shows an exploded view of a possible implementation of the device according to the present invention. It is seen in particular therein that the discharge electrode 1 can be attached without distinction to the frame in which the main flow takes place or can be incorporated in the vapor ejection nozzle 13. In both cases, the discharge electrode 1 can be short and relatively thick, in which case the discharge will take place solely at the tip of the discharge electrode 1; or else it can be thin and can pass through the entire chamber 7 (the pipe), in which case the discharge takes place over the entire length of the discharge electrode 1 (the term used is discharge wire). 14 indicates a low voltage electrical control box and 15 indicates a detection device (the analytical unit).

The discharge electrode 1 is generally in the middle of the chamber 7. Preferably, the discharge electrode is situated in the axis of the vapor delivery tube.

The discharge electrode 1 can have various forms, for example a comb form or a square cross section. It is necessary, in order to generate a localized discharge, for it to have one or more regions having a radius of curvature sufficiently small to initiate the discharge. It is preferable for the discharge electrode to be a tip or a wire.

The electrodes 1 or 2 can be composed of different conducting materials, for example stainless steel or conducting plastics.

The counterelectrode 2 can be composed of a compact or porous conducting material, generally metal. If a porous conducting material is used, it can be provided in various forms: perforated metal, porous sintered metal, one or more layers of wire mesh preferably wound in the form of a cylinder, a pad of metal fibers or wires in the form of a cylinder, and the like. While the gas flows through the porous medium, the particles are transported close to the surface of the conducting elements, thus allowing the charged particles to be efficiently deposited at the surface of the conducting elements of the porous medium. If nonporous collecting electrodes are used, such as a nonporous tube surrounding the central discharge electrode, the charged particles have to be precipitated by the electric force through the fluid boundary layer adjacent to the internal surface of the tube which surrounds it.

In a preferred exemplary embodiment of the present invention, the counterelectrode 2 is provided with a cooling system.

It is preferable, according to the method for recovering the particles, for the counterelectrode 2 to be rendered hydrophilic or hydrophobic by a surface treatment. This treatment can consist of a grooving (which renders the surface highly wetting by capillary action) or of a chemical deposition.

The present device is highly efficient and can be made small in size. The cylindrical shape with a circular transverse cross section is the most appropriate form in numerous applications. However, it is not necessary to have a transverse cross section of circular shape in order to make use of the many advantages of the invention. Rectangular or elliptical transverse cross sections or transverse cross sections of other shapes can be used in the device according to the present invention.

The device of the present invention can be provided in various sizes. Thus, in the exemplary embodiment of FIG. 4, the diameter of the cylinder (counterelectrode) is 50 mm and the external diameter of the nozzle is 5 mm and the internal diameter 4 mm. However, this diameter does not have a fundamental effect on the formation of the droplets.

In the context of the present invention, it is advantageous for the main air stream comprising the particles to enter tangentially to the walls of the channel (chamber 7) so as to obtain a helical flow. This flow makes it possible, on the one hand, to convey the larger particles to the counterelectrode 2 via the centrifugal force and, on the other hand, to stabilize the flow of vapor generated around the discharge electrode in order to make sure that a cylindrical sheathing of vapor surrounds the discharge electrode 1 over its entire length.

Figure 5:
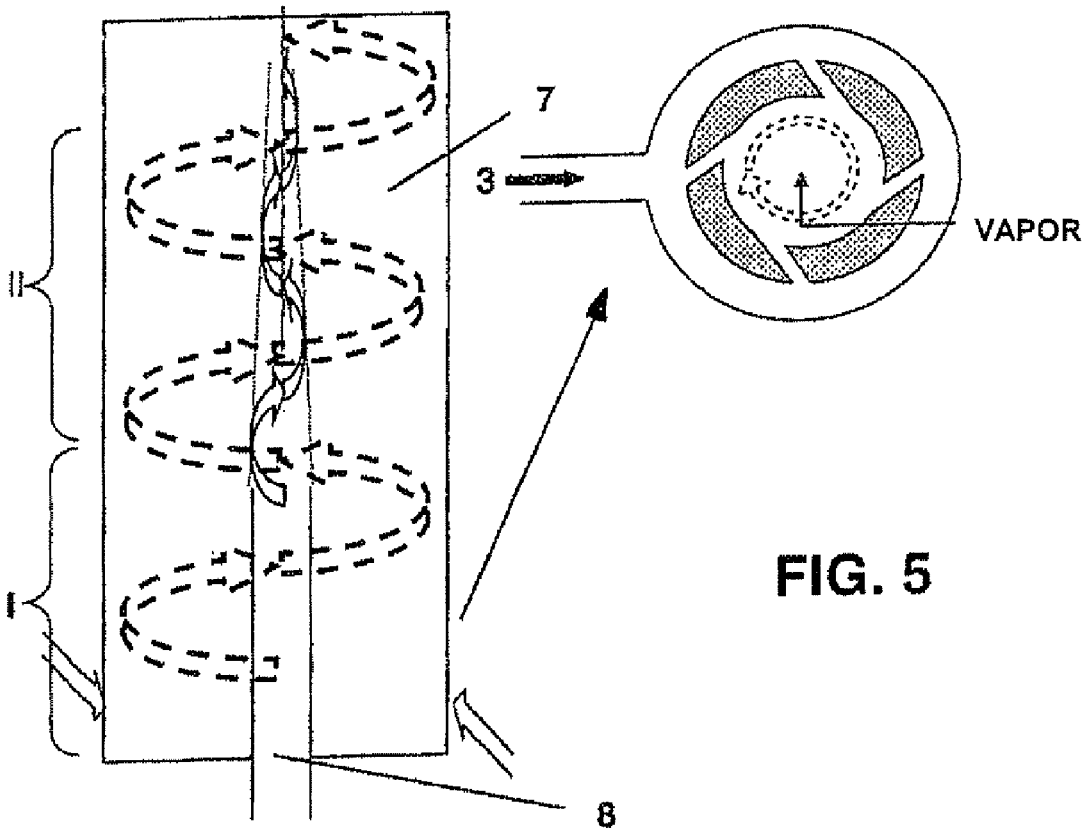
FIG. 5 shows that a rotary flow in the chamber comprising a discharge electrode and a counterelectrode makes it possible to stabilize the jet of vapor.

FIG. 5 shows that a rotary flow makes it possible to stabilize the jet of vapor exiting from the vapor delivery tube 8. FIG. 5 illustrates the use of inlets tangential to the main channel in order to create a helical air flow in the chamber 7. 3 indicates an inlet for the air and aerosol mixture. This makes it possible to stabilize the region of vapor, which is thus confined to a cylinder surrounding the discharge electrode 1. Moreover, it is possible, in this way, to separate the collector (counterelectrode 2) into two areas:

In the area I, the largest particles are gathered by a cyclone effect (they are carried towards the outside via centrifugal force):

In the area II, the smaller particles are gathered using electrostatic forces.

The use of a helical main flow makes it possible to stabilize the vapor flow and also to rapidly collect the larger particles. It is thus preferable for the flow of air and of aerosol to enter tangentially to the walls of the chamber 7 in order to create a helical flow.

Figure 6:
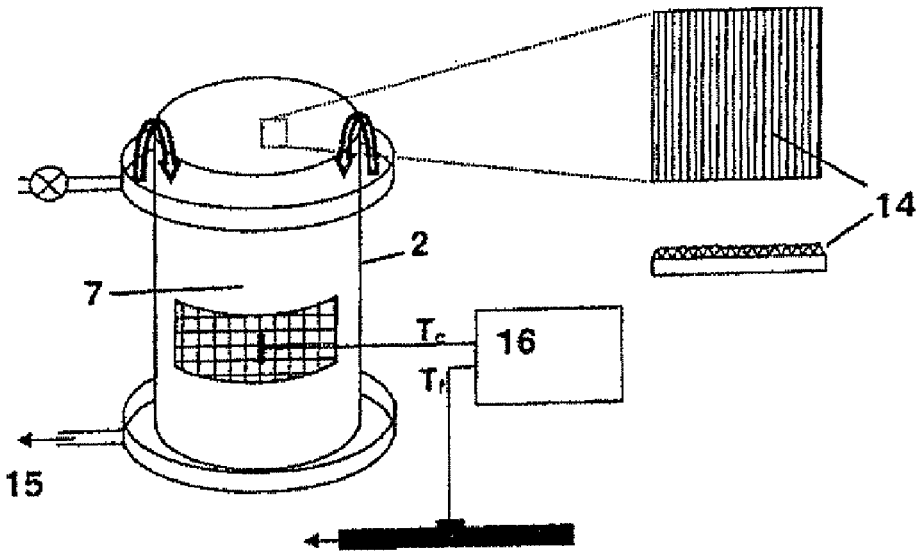
FIG. 6 shows a device according to the present invention with a system for collecting the particles which have impacted the counterelectrode using microfluid channels.

Moreover, it is advantageous for the collecting electrode (counterelectrode 2) to be subjected to a surface treatment (grooving or other similar treatment) in order to render it very hydrophilic and to make uniform the deposition of the droplets over the entire surface via a type of film. FIG. 6 shows a device according to the present invention with a system for collecting the particles which have impacted the counterelectrode 2 using microfluid channels 14. The structuring of the counterelectrode 2 makes it possible to continually retain a liquid film which wets the surface without having to continually feed it.

In addition, it is advantageous for the counterelectrode 2 to be partially immersed in a tank comprising a solvent. The solvent is preferably water. In this case, the counterelectrode 2 is partially in a tank comprising solvent in order to wet the counterelectrode 2 with a film of this solvent. This solvent is preferably water which can comprise additives.

It is thus advantageous to bathe one end of the counterelectrode 2 in a tank of water. In this alternative form, the water will then cover the whole of the surface due to capillary forces and it is not necessary to continually feed the surface in order to keep it wet. A film of water is thus formed over the entire surface of the counterelectrode 2 on which the particles arrive. This film can be set in motion using an electrically-operated valve in order thus to continuously gather the particles collected and to carry out the treatment in real time. Such a device does not impose any flow rate constraints, it being clearly understood that, the greater the output flow rate, the more the particles will be diluted.

In a preferred alternative form, the particles collected are conveyed, after their recovery, to the analytical unit 15, which can be combined with the device of the present invention. The particles are continuously collected in the film covering the counterelectrode, from which a small amount of water to be analyzed can then be withdrawn at regular intervals. The departure from the device preferably takes place in the aqueous phase in order to allow analysis.

FIG. 6 shows the device for wetting the collecting electrode. When excess water is conveyed to the top tank, it flows out by a siphon effect along the counterelectrode 2: a controlled flow rate is thus present, while keeping the electrode 2 continuously wetted. The Peltier cell 16 makes it possible to cool the film of water in order to prevent it from evaporating, while preheating the water intended to be vaporized. 15 indicates the detection device.

The water used for the vaporization around the discharge electrode 1 must be pure in order to make sure that the nucleation of drops takes place only around the particles of interest (for example microorganisms), while the water used to wet the counterelectrode 2 may contain additives (surfactants, pH buffer).

It is advantageous, in order to limit the evaporation of the solvent (for example a film of water) on the counterelectrode, to put a cooling system on the counterelectrode. It is advantageous to use a Peltier cell 16, the hot source of which will be the water intended to be vaporized. This water is thus preheated and the energy necessary for the vaporization is limited.

In addition, cooling the walls of the collecting unit can be advantageous in accelerating the condensation of the water vapor around the solid particles which are thus trapped in droplets, the radius of which increases during their axial and radial transit.

The device according to the present invention can additionally comprise collecting means using capillary action, gravity or shearing of the air.

Figure 7:
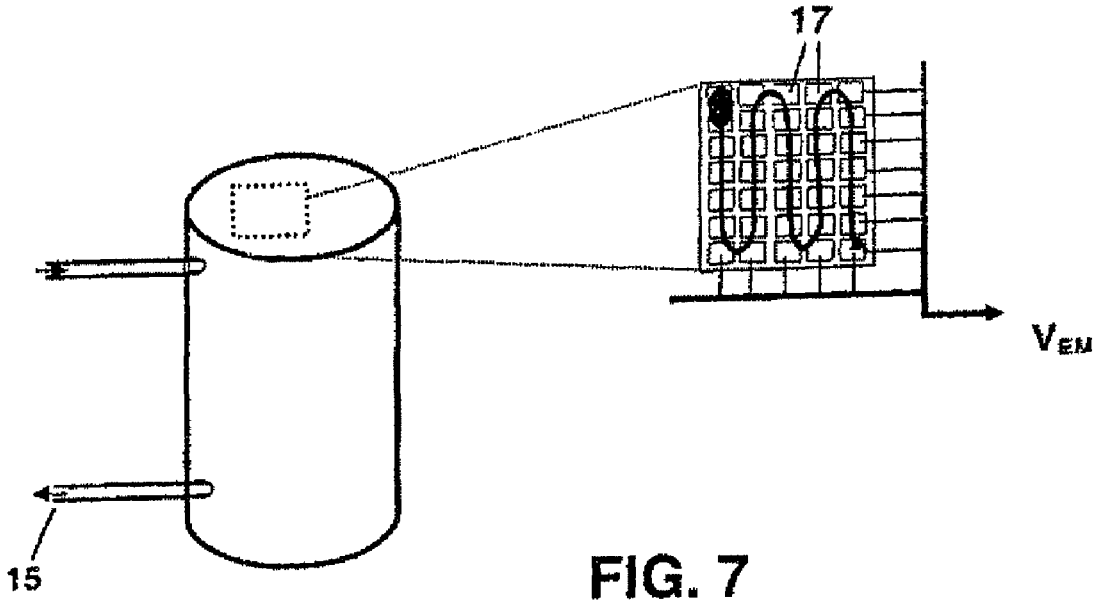
FIG. 7 shows a device according to the present invention with a system for collecting the particles which have impacted the counterelectrode using systematic sweeping by electrowetting of the counterelectrode.

FIG. 7 shows a device according to the present invention with a system for collecting the particles which have impacted the counterelectrode 2 using systematic sweeping by electrowetting of the counterelectrode 2.

It is advantageous, if the surface of the collecting electrode is not functionalized in an incompatible fashion (for example by grooving), to position thereon an electrode grid 17 (cf. FIG. 7). FIG. 7 illustrates the possibility of using a matrix of electrodes addressable in position by a voltage sufficiently strong to bring about the displacement of a drop of water (containing possible additives) in order to sweep the entire surface of the collecting electrode. It is then possible, while successively bringing these electrodes 17 to a potential of the order of a few tens of volts (typically: 60 volts), to move a drop over the surface of the counterelectrode 2 by electrowetting. It is thus possible to sweep, with a single drop, the entire surface of the electrode 2, drastically reducing the amount of water necessary to collect the particles or droplets.

According to the time spent by the drop of water in the device, it may be necessary to add thereto a cooling system, for example a Peltier cell 16 (see FIG. 6).

Finally, the complete system may use several modules, such as that described above, in order to increase the flow rate of air to be treated while preferably retaining a laminar flow inside each module since the flow rate by each of the modules remains the same. Each of the modules typically has a diameter of a few cm and a height of approximately 10 cm or several tens of cm.

Figure 8:
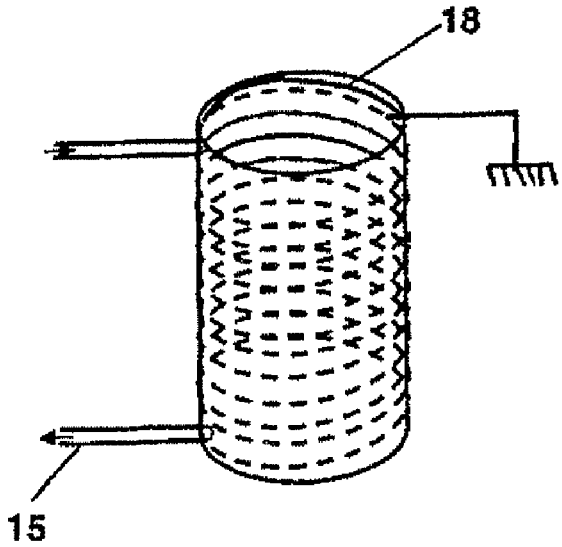
FIG. 8 illustrates an exemplary embodiment of the present invention where a helical groove can be machined on the inside face of the chamber of the device according to the present invention comprising electrodes (main pipe) in order to gather the particles and to form an interlacing with the counterelectrode, itself also composed of a helical wire.

FIG. 8 illustrates that a helical groove 18 can be machined on the inside face of the main pipe (chamber 7) in order to gather the particles and form an interlacing with the counterelectrode 2, itself also composed of a helical wire. This solution makes it possible to limit the surface area of the counterelectrode and thus not to have to functionalize the latter.

FIG. 9 illustrates that the use of a flat counterelectrode 2 can be envisaged in order to facilitate the collecting of the particles.

FIG. 10 shows a second example of a flat configuration which can be envisaged. 8 refers to a vapor delivery tube and 15 to a detection device (the analytical unit). 19 indicates the collecting areas (counterelectrode 2), 20 indicates a waste container, 21 indicates a reagent and 22 indicates the electrodes for moving the drops by electrowetting.

The device of the present invention can comprise collecting means of gravity type (the droplets flow below the counterelectrode by virtue of gravity) or air shearing type (the droplets are swept along the counterelectrode by the air stream present within the device).

The commonest applications of the present invention are the extraction of particles suspended in air for the purpose of their subsequent analysis (monitoring of pollution, prevention of bioterrorism). Any constituent of the air, such as gases, microbes (including microorganisms such as spores, bacteria or fungi), dust or any other particle which is entrained or transported by the air, can be ionized by the electrostatic field, collected by the collecting electrode and, if need be, analyzed.

The invention relates mainly to a use in which the objective is to collect the particles in a volume of water which is as small as possible, for the purpose of subsequent biological analysis, The term used is then microbiological extraction devices.

The present invention contributes several specific advantages. The device envisaged differs from the conventional devices in several respects:

The use of water vapor instead of mist (droplets, as is the case in conventional wet electrostatic filters) makes it possible to increase the efficiency in collecting submicronic particles. This remains valid if a solvent other than water is used for the formation of vapor. The use of water vapor guarantees that the condensation to give droplets takes place around the particles present in the air.

As the water vapor is confined to a small volume, water consumption is sufficiently low for autonomous use to occur for at least a day with a main tank containing a few liters of water.

The small format of the device makes it possible to use a large number of them in parallel while keeping the system portable. It is thus easy to calibrate the final system according to the requirements of analysis by varying the number of modules used in parallel.

The invention will be of use in particular in the deploying of mobile air analysis markers for the purpose of detecting submicronic particles present in the form of traces in the atmosphere (bacteria and viruses). It is possible to envisage, for example, installing such markers at the outlets of high-risk industries in order to detect, in real time, the presence of Legionnaires' disease.

The device of the present invention makes possible the separation, by a system of electrostatic filters, of the liquid or solid particles with a size of between 10 nm and 100 μm in suspension in a gas. It makes possible in particular the collecting of particles measuring between 50 nm and 10 μm with high efficiency, and a consumption of energy and of water compatible with portable use.

In addition, the invention provided makes possible the efficient collecting of submicronic particles in suspension in air for the purpose of their analysis. The device may also be transportable and have a consumption of energy and of products (essentially water) sufficiently low to be suitable for autonomous use.

What is claimed is:

1. A device for air/water extraction by semi-wet electrostatic collection, comprising:

a chamber (7) comprising a discharge electrode (1) for creating a stream of ions from an ionized pocket of gas surrounding the discharge electrode (1) and a counterelectrode (2), an inlet (3) for the air and aerosol mixture to be extracted which comprises liquid or solid particles, a vapor delivery tube (8) and an outlet (4) for the cleaned air, wherein said device is adapted to introduce vapor via said vapor delivery tube (8) into a space between the discharge electrode (1) and the counterelectrode (2) so as to form a sheathing of vapor (10) surrounding the discharge electrode (1) over its entire length, so that all the air treated is not saturated in vapor and wherein said device additionally comprises collecting means using capillary action , gravity or shearing with air.

2. The device as claimed in claim 1, wherein said counterelectrode (2) is partially immersed in a tank comprising a solvent.

3. The device as claimed in claim 2, wherein said solvent is water.

4. The device as claimed in claim 1, wherein said discharge electrode (1) is situated in the axis of the vapor delivery tube (8).

5. The device as claimed in claim 1, wherein said discharge electrode (1) is a tip or a wire.

6. The device as claimed in claim 1, wherein said counterelectrode (2) is provided with a cooling system (16).

7. The device as claimed in claim 1, wherein said counterelectrode (2) is rendered hydrophilic by a surface treatment.

8. The device as claimed in claim 7, wherein said treatment is a grooving.

9. A process for collecting, by the wet electrostatic method, liquid or solid particles with a size of between 10 nm and 100 μm in suspension in a gas using the device as claimed in claim 1, said process comprising:

(a) introducing vapor into the space between the counterelectrode (2) and the discharge electrode (1) in order to establish a sheathing of vapor (10) around the discharge electrode (1), (b) introducing an air and aerosol mixture in the form of a flow into the space between the discharge electrode (1) and the counterelectrode (2), (c) ionizing the vapor molecules by the discharge electrode (1), (d) charging particles with the ionized vapor molecules, (e) growing the charged particles to form droplets, and (f) conveying said droplets to the counterelectrode (2), and precipitating said droplets on the counterelectrode (2), (g) recovering the droplets, and transporting the droplets in order to be analyzed.

10. The process as claimed in claim 9, wherein said vapor is water vapor.

11. The process as claimed in claim 9, wherein said flow of air and of aerosol is laminar.

12. The process as claimed in claim 11, wherein said flow of air and of aerosol enters tangentially to the walls of the chamber (7) in order to create a helical flow.

13. The process as claimed in claim 9, wherein said counterelectrode (2) is partially in a tank comprising solvent in order to wet the counterelectrode (2) with a film of this solvent.

14. The process as claimed in claim 9, wherein said solvent is water which can comprise additives.

15. A device for air/water extraction by semi-wet electrostatic collection, comprising:

a chamber (7) comprising a discharge electrode (1) and a counter-electrode (2), an inlet (3) for introducing an air and aerosol mixture to be extracted which comprises liquid or solid particles, a vapor delivery tube (8), and an outlet (4) for the cleaned air, wherein said discharge electrode (1) is situated in the axis of the vapor delivery tube (8), and the device is adapted to introduce vapor via said vapor delivery tube (8) into a space between the discharge electrode (1) and the counterelectrode (2) so as to form a sheathing of vapor (10) surrounding the discharge electrode (1) over its entire length, so that all the treated air and aerosol mixture is not saturated in vapor and wherein said device additionally comprises collecting means using capillary action, gravity or shearing with air.

16. The device as claimed in claim 15, wherein said vapor delivery tube (8) has a nozzle, and said nozzle and vapor delivery tube (8) are adapted to discharge vapor having the following properties: a pressure slightly greater than or equal to atmospheric pressure, a temperature equal to the boiling point 100 C at atmospheric pressure or greater, and a flow rate lower than five hundredths of the flow rate of air and aerosol mixture introduced via the inlet (3).

17. A device for air/water extraction by semi-wet electrostatic collection, comprising:

a chamber (7) comprising a discharge electrode (1) for creating a stream of ions from an ionized pocket of gas surrounding the discharge electrode (1) and a counterelectrode (2), an inlet (3) for introducing an air and aerosol mixture to be extracted which comprises liquid or solid particles, a vapor delivery tube (8), and an outlet (4) for the cleaned air, wherein the device is adapted to introduce vapor via said vapor delivery tube (8) into a space between the discharge electrode (1) and the counterelectrode (2) so as to form a sheathing of vapor (10) surrounding the discharge electrode (1) and wherein said device additionally comprises collecting means using capillary action, gravity or shearing with air.

* * * * *